US008387985B1

(12) United States Patent
Itkis et al.

(10) Patent No.: US 8,387,985 B1
(45) Date of Patent: Mar. 5, 2013

(54) BINGO GAME INCLUDING BONUS AWARD AND METHOD OF CONDUCTING THE SAME

(75) Inventors: Yuri Itkis, Las Vegas, NV (US); Horia Mihai Preda, Las Vegas, NV (US); Ioan M. Puscas, Las Vegas, NV (US)

(73) Assignee: Fortunet, Inc., Las Vegas, NV (US)

( * ) Notice: Subject to any disclaimer, the term of this patent is extended or adjusted under 35 U.S.C. 154(b) by 81 days.

(21) Appl. No.: 12/854,759

(22) Filed: Aug. 11, 2010

Related U.S. Application Data

(63) Continuation-in-part of application No. 12/043,086, filed on Mar. 5, 2008, now Pat. No. 7,775,521.

(60) Provisional application No. 60/893,035, filed on Mar. 5, 2007.

(51) Int. Cl.
*A63F 3/06* (2006.01)

(52) U.S. Cl. ..... 273/269; 273/144 B; 273/144 R

(58) Field of Classification Search ..... 273/269, 273/144 B, 144 R
See application file for complete search history.

(56) References Cited

U.S. PATENT DOCUMENTS

| | | | | |
|---|---|---|---|---|
| 5,257,784 | A * | 11/1993 | Boylan et al. | 463/18 |
| 5,590,879 | A | 1/1997 | Tripp | |
| 5,799,940 | A | 9/1998 | Tripp | |
| 6,120,024 | A | 9/2000 | Lind | |
| 2004/0204225 | A1 * | 10/2004 | Campo et al. | 463/19 |
| 2007/0108700 | A1 | 5/2007 | Bigelow | |

* cited by examiner

*Primary Examiner* — Benjamin Layno
(74) *Attorney, Agent, or Firm* — Greenberg Traurig

(57) ABSTRACT

A system and method for awarding bonus prizes is paid responsive to the last two or more bingo balls called during a bingo game (e.g., last five balls form a predetermined combination of bingo letters). For example, if the last five balls called in a bingo game are an "O" ball, preceded by a "G" ball, preceded by an "N" ball, preceded by an "I" ball, and preceded by a "B" ball, the last five balls called or selected in the bingo game spell the word "BINGO" and accordingly, the winning bingo card is paid a jackpot prize. Another example of a bonus combination is the last three balls spelling the word "BIG." Yet another example of a bonus combination is the word "BIG" being spelled by bingo balls selected by a pair of ball blowers working in tandem.

9 Claims, 9 Drawing Sheets

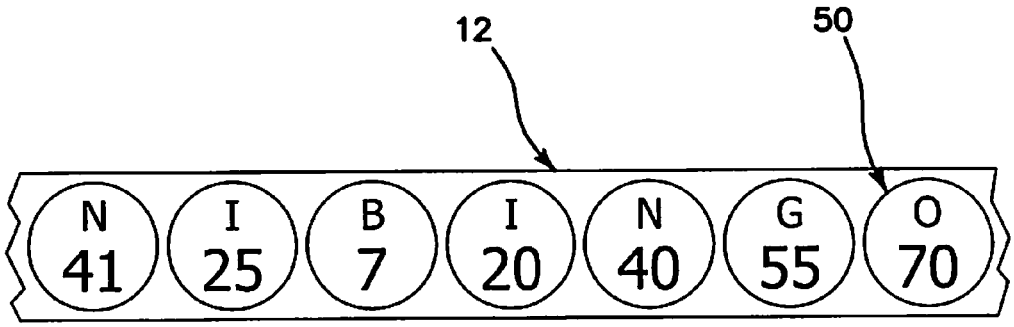
FIG. 9
FIG. 10
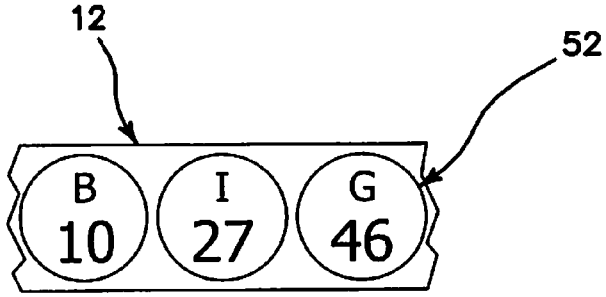
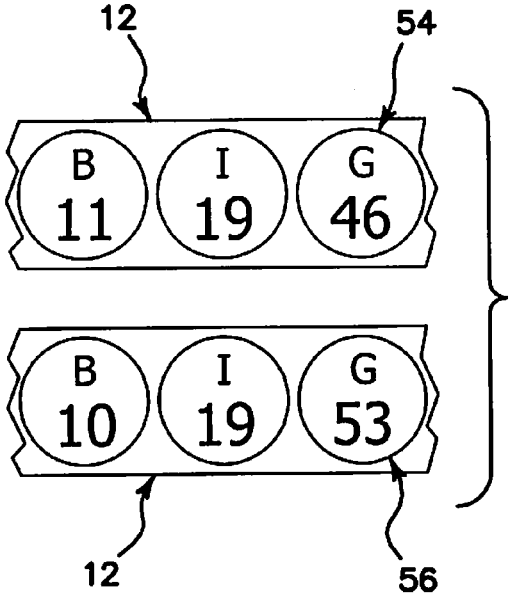
FIG. 11

BINGO GAME INCLUDING BONUS AWARD AND METHOD OF CONDUCTING THE SAME

CROSS-REFERENCE TO RELATED APPLICATION

This application is a continuation-in-part of U.S. application Ser. No. 12/043,086 filed on Mar. 5, 2008, now U.S. Pat. No. 7,775,521 which claims the benefit of U.S. Provisional Patent Application No. 60/893,035 filed on Mar. 5, 2007, both of which are incorporated herein in their entirety by reference.

FIELD OF THE INVENTION

The embodiments of the present invention relate to gaming systems, more specifically, the embodiments relate to ball blowers operable as random number generators and a bonus game facilitated thereby.

BACKGROUND

Various bonus prizes are often awarded in bingo games. One popular type of bonus prize in bingo games is the so-called "hot ball" or "cash ball," wherein a bonus prize is awarded responsive to a bingo game ending (i.e., one or more bingos) with a predetermined bingo number being called as the last bingo number in the game. Such bonus prizes are typically presented in the form of a progressive jackpot. Although such a jackpot method may be very attractive to players due to its high monetary value, the jackpot method often lacks the important element of anticipation because when the "hot ball" is called in the beginning of the bingo game (i.e., before a bingo occurs) players immediately realize that they have no chance of winning the jackpot during the current bingo game.

In another example, a progressive jackpot scheme disclosed in U.S. Pat. Nos. 5,727,786 and 6,565,091 (both to Weingardt) also lacks the all-important element of anticipation, at least for the players playing paper bingo cards, because such players cannot readily discern the random pattern of colors applicable to their bingo cards in accordance with the current set of random colors assigned to the bingo numbers on a multicolor bingo flashboard. Moreover, the Weingardt systems require complex and expensive systems that are too costly for most bingo halls.

Accordingly, there is the need for the capability of offering bingo players attractive bonus prizes while preserving the element of anticipation, without the need for expensive additional equipment that is not typically present in bingo halls.

SUMMARY

The embodiments of the present invention involve a bonus prize, such as a progressive jackpot prize, award to a player playing a winning bingo card responsive to a group of bingo balls called last in the bingo game forming a winning combination of bingo letters which spell "BIG" and/or "BINGO" or other selected phrases. Since the identity of the last several balls (e.g., last five balls) called in the bingo game is not known in advance, the players continue to anticipate the bingo game outcome throughout the entire bingo game.

Other variations, embodiments and features of the present invention will become evident from the following detailed description, drawings and claims.

BRIEF DESCRIPTION OF THE DRAWINGS

FIG. 9 illustrates a "BINGO" bonus prize ball combination according to the embodiments of the present invention;

FIG. 10 illustrates a "BIG" bonus prize ball combination according to the embodiments of the present invention; and FIG. 11 illustrates a duel "BIG" ball combination generated by two ball blowers according to the embodiments of the present invention.

DETAILED DESCRIPTION

It will be appreciated by those of ordinary skill in the art that the invention can be embodied in other specific forms without departing from the spirit or essential character thereof. The presently disclosed embodiments are therefore considered in all respects to be illustrative and not restrictive.

Figure 1:
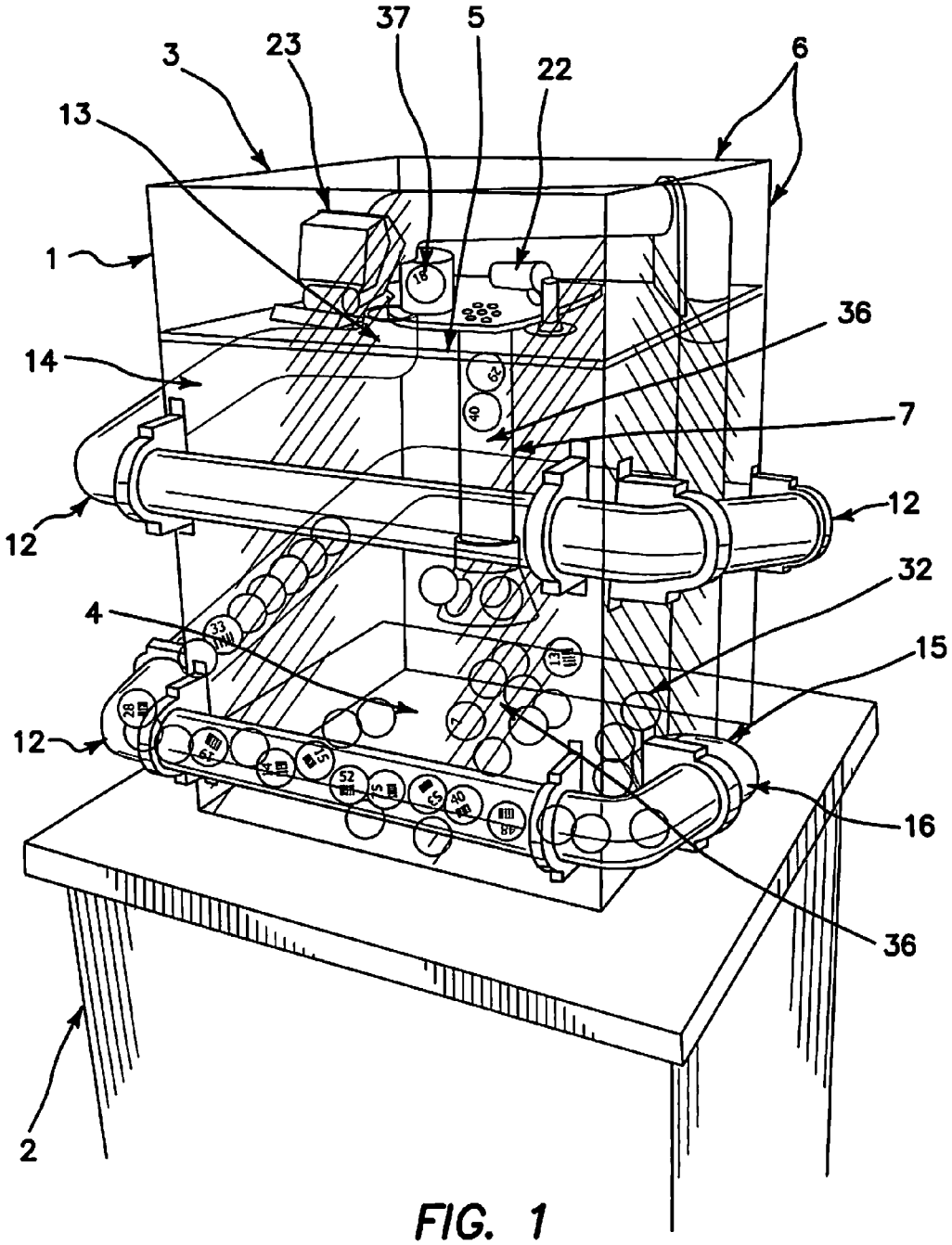
FIG. 1 illustrates a perspective view of an embodiment of the smart ball blower.

Initial reference is made to FIG. 1 showing an automatic ball blower having a ball mixing chamber 1 positioned on a support stand 2. In one embodiment, the mixing chamber 1 is fabricated of Plexiglas (or any suitable material) in the form of an inverted vertical hollow rectangular prism 3 finished by or glued to a pyramid 4, which can also be fabricated of Plexiglas (or any suitable material). As shown, the mixing chamber 1 is mounted upside down on the support stand 2. The upper portion of the mixing chamber 1 houses a horizontal support plate 5 that can be attached to the walls 6 of the mixing chamber 1 using screws and small mounting brackets or other suitable means. Like the mixing chamber 1, the support plate 5 is fabricated of Plexiglas (or any suitable material). Although the Plexiglas for the mixing chamber 1 and the support plate 5 is transparent as shown, it is understood that the Plexiglas can be partially transparent or opaque.

Figure 2:
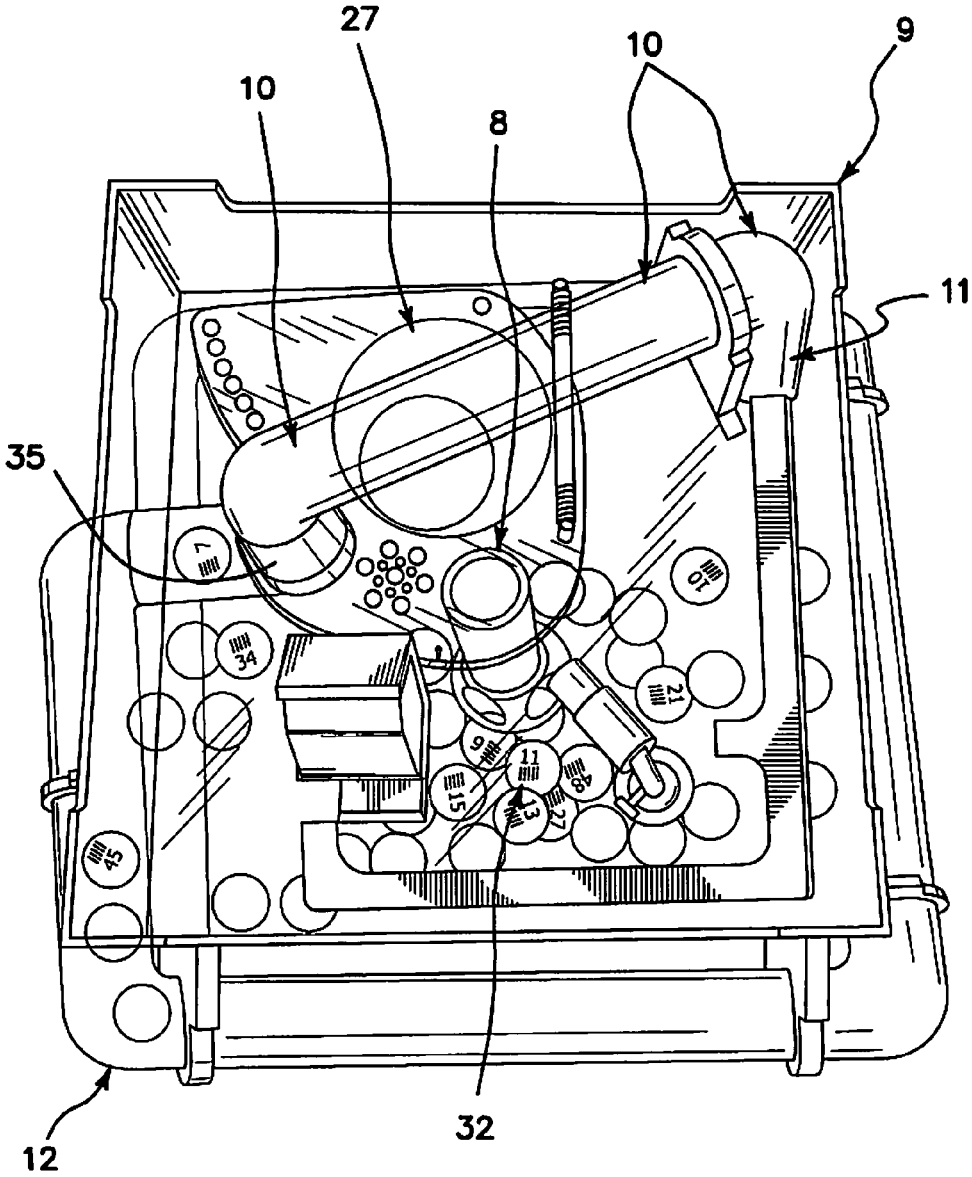
FIG. 2 illustrates an upper view of an embodiment of a smart ball blower.

Inside the mixing chamber 1 is a central ball ejection tube 7 attached to the support plate 5 through an opening 8 in the center of the support plate 5 as best shown in FIG. 2. Also inside the mixing chamber 1, near a corner 9, is a reverse U-shaped auxiliary tube 10 that pierces through the support plate 5 at a circular opening 11. Like the mixing chamber 1, the ejection tube 7 and the auxiliary tube 10 can be fabricated of Plexiglas or other suitable materials.

A spiraling ball return tube 12 circumscribes the exterior surface of the mixing chamber 1. Although the return tube 12 is shown as a circular transparent tube positioned external to ball mixing chamber 1, the return tube 12 can also be implemented as a triangular or rectangular metal or any other cross-sectional shaped air duct on the exterior or interior surfaces of the mixing chamber 1. In addition, like the mixing chamber 1, the return tube 12 is fabricated of Plexiglas (or any suitable material) and can be completely or partially transparent.

Figure 3:
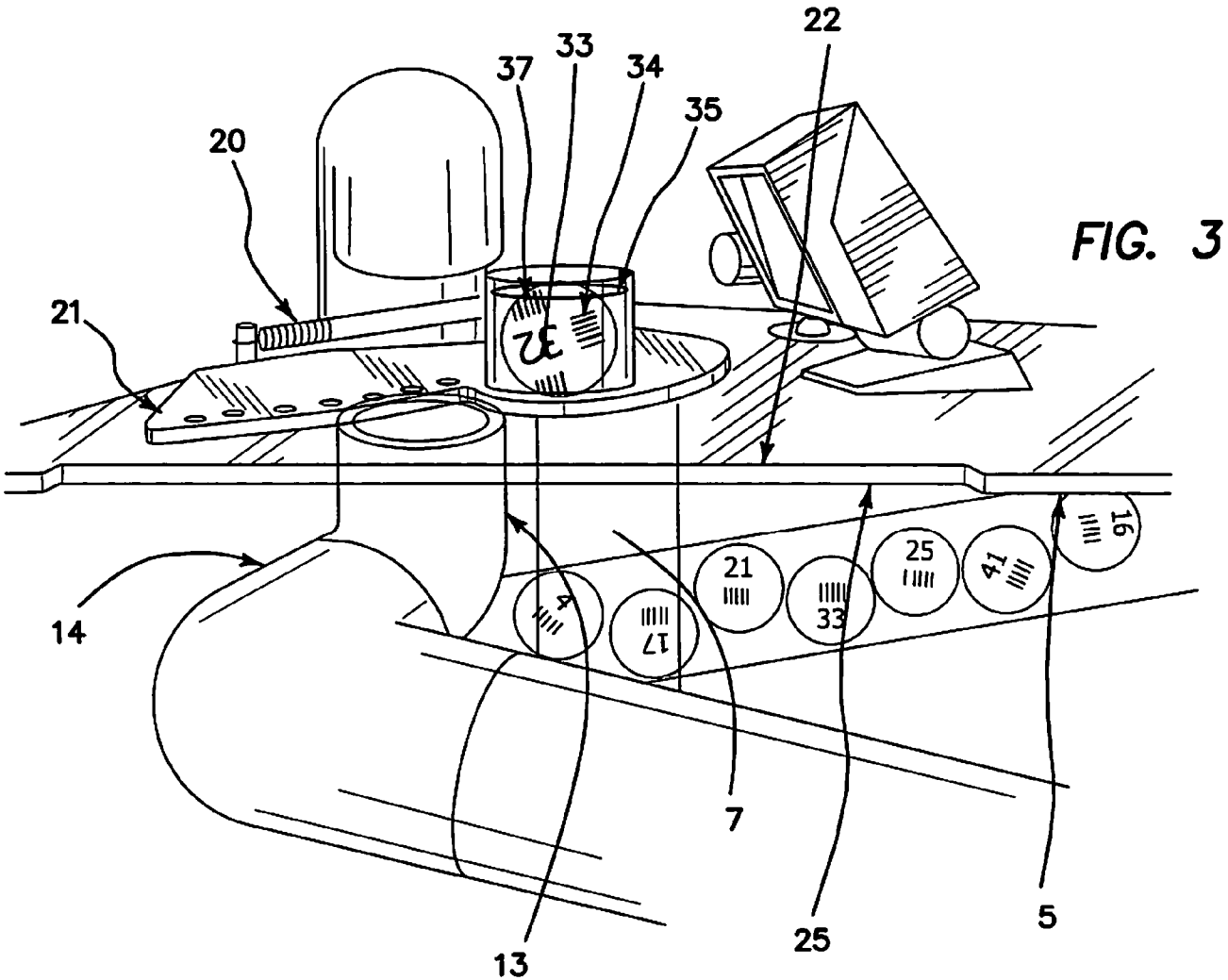
FIG. 3 illustrates a side view of a ball carriage mechanism.
Figure 5:
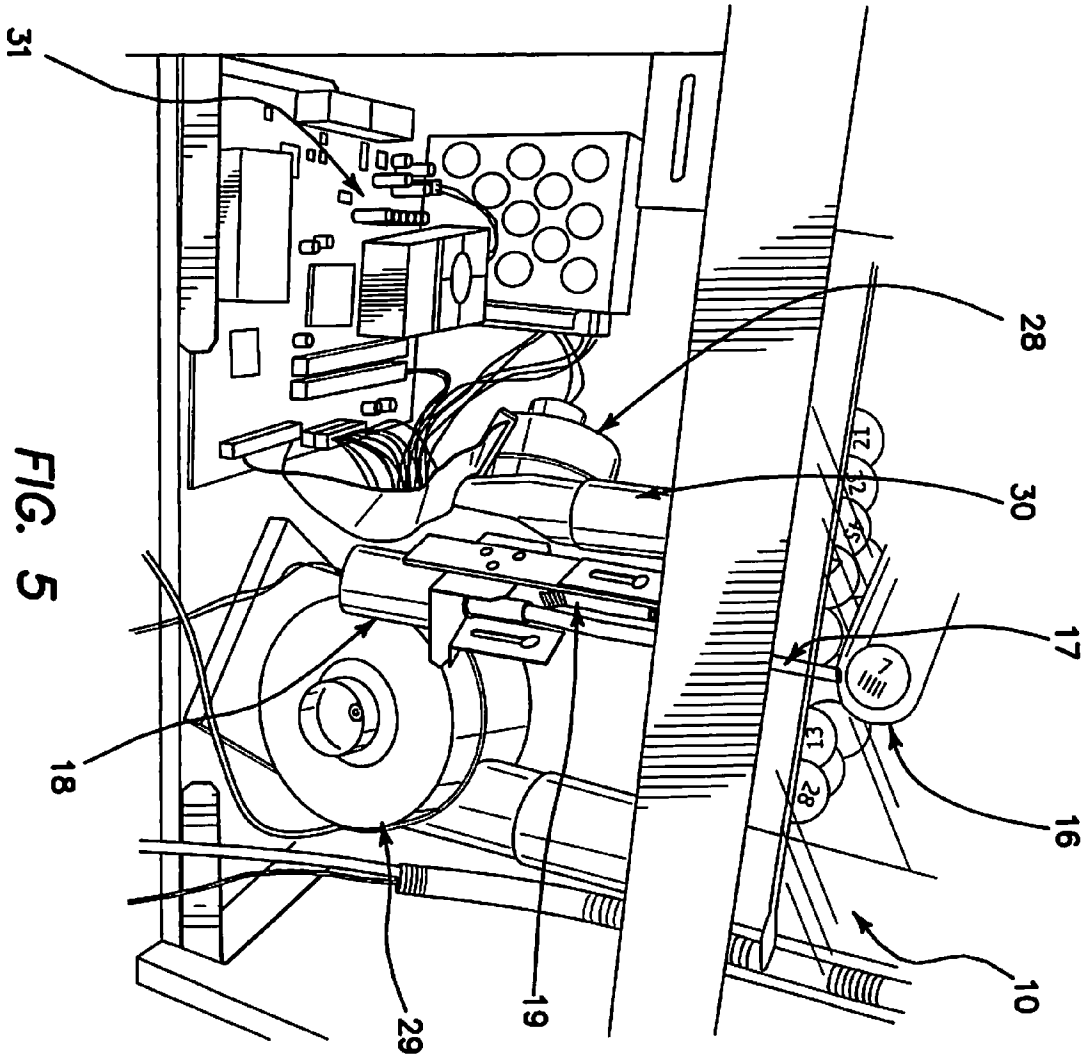
FIG. 5 illustrates a perspective view of a support stand with an access door in an open position.

An inlet 13 of the return tube 12 can be located inside the mixing chamber 1 under the support plate 5 as shown in FIG. 3. The body of the return tube 12 penetrates one of the walls 6 of the mixing chamber 1 at an upper point 14, curves around the exterior of the other walls 6 of the mixing chamber 1, and re-enters the mixing chamber 1 through an opening 15 located at a lower point of the mixing chamber 1. As best shown in FIG. 5, the bottom end of the return tube 12 forms a ball outlet 16 gated by a pull-in slidable and/or extendable metal or Plexiglas shaft 17 controlled by a solenoid 18. Biased by a spring 19, the shaft 17 normally closes, at least partially, the outlet 16.

Figure 4:
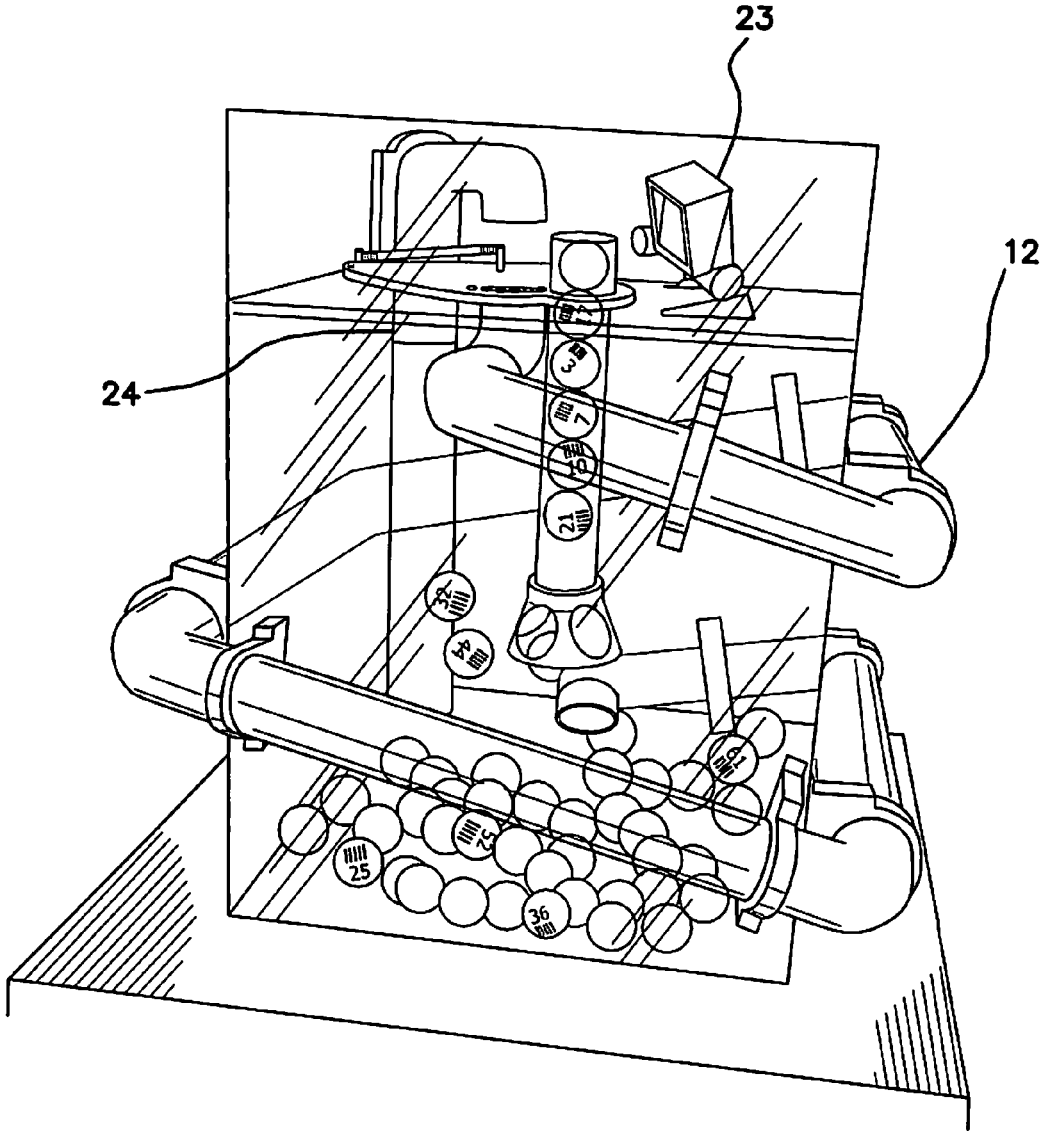
FIG. 4 illustrates a side view of an embodiment of a smart ball blower.
Figure 8:
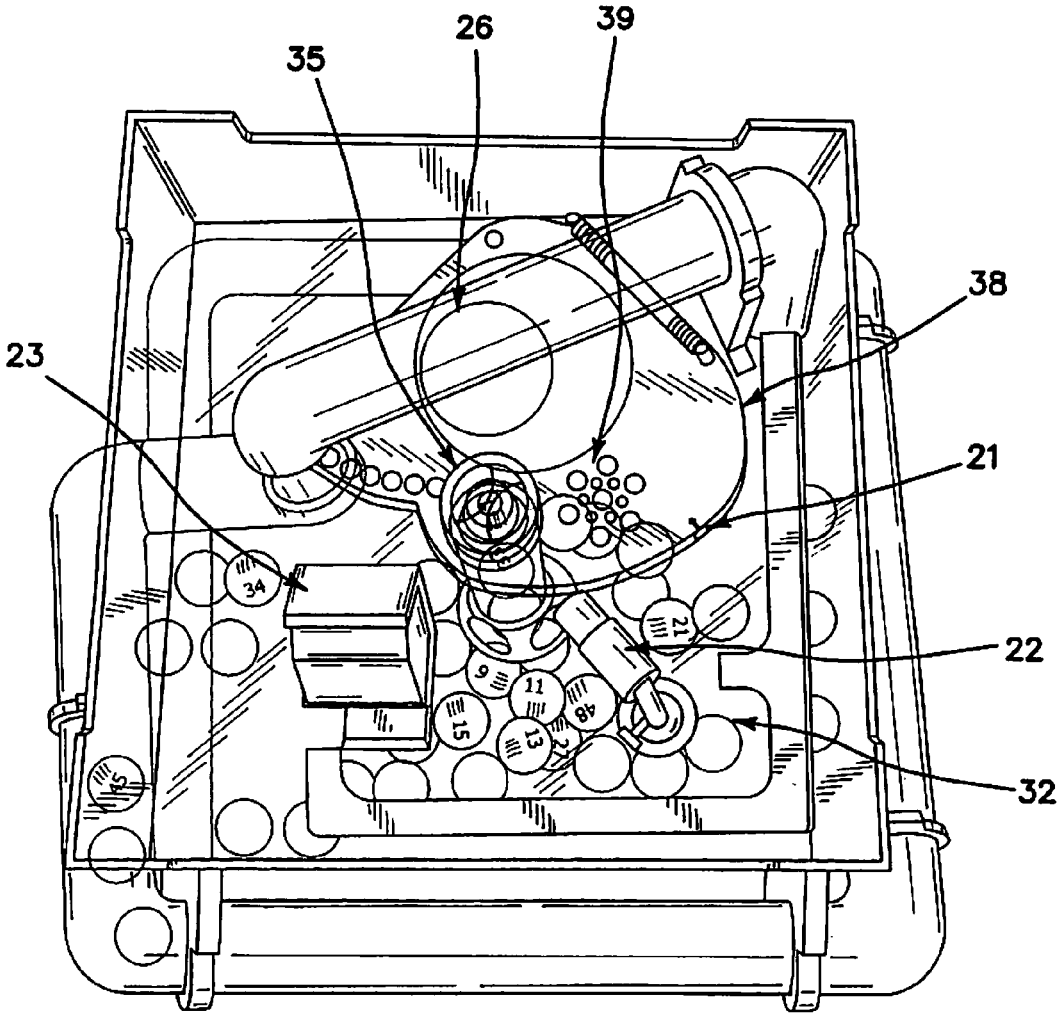
FIG. 8 illustrates an upper view of an embodiment of a smart ball blower with a ball positioned such that the number thereon is exposed to a TV camera.

Referring again to FIG. 3, the support plate 5 supports a spring-loaded (by spring 20) ball carriage mechanism 21 slidably mounted on the top surface 22 of the support plate 5. A digital TV camera 22 and barcode reader or scanner 23 is mounted adjacent thereto on the top surface 22 of the support plate 5. In one embodiment, the barcode scanner 23 is omni-directional. A stepper motor 24 (see FIG. 4), having a circular frictional gear disc 26 securely mounted on the shaft of the motor 24 (see FIG. 8), is mounted on the bottom surface 25 of the support plate 5. The gear 26 frictionally engages an inner surface of a camera opening 27 in the carriage 21 as shown in FIG. 2.

Referring now to FIG. 5, the support stand 2 is fabricated of wood or other rigid material and is configured to house two air blowers, namely, a main air blower 28 and an auxiliary air blower 29. However, the support stand 2 can also be fabricated to house more or fewer than two air blowers 28, 29. The main air blower 28 is attached to the mixing chamber 1 at a bottom opening via a manifold 30 while the auxiliary air blower 29 is attached to a bottom inlet of the reverse U-shaped auxiliary tube 10.

In addition to the two air blowers 28, 29, the support stand 2 is also configured to house a processor or computer 31 (e.g., personal computer) and other electronic components (not shown). The computer 31 is programmed to electronically control the air blowers 28, 29, the TV camera 22, the barcode reader or scanner 23, the stepper motor 24 and/or the solenoid 18. Optionally, the computer 31 may communicate with a reflective photo-interrupter (not shown).

The mixing chamber 1 houses a plurality of plastic balls 32, e.g., seventy-five bingo balls 32. Each of the plastic balls 32 can be individually marked or imprinted with a unique ball number 33 and a unique barcode 34 corresponding to the ball number 32 as best shown in FIG. 3. In one embodiment the balls 32 are hollow (i.e., filled with air).

In one embodiment as described above, a majority of operations of the automatic ball blower are controlled by the computer 31. Before a round of game (e.g., bingo) begins, the computer 31 deactivates both the main blower 28 and the auxiliary blower 29 as well as the solenoid 18 and the stepper motor 24. As a result, the spring loaded shaft 17 of the solenoid 18 returns to its normal closed (extended) position and the spring loaded carriage 21 returns to its default position in which the ball capture cup 35 of the ball carriage 21 is positioned over the outlet (top opening) of the ejecting tube 7.

Figure 6:
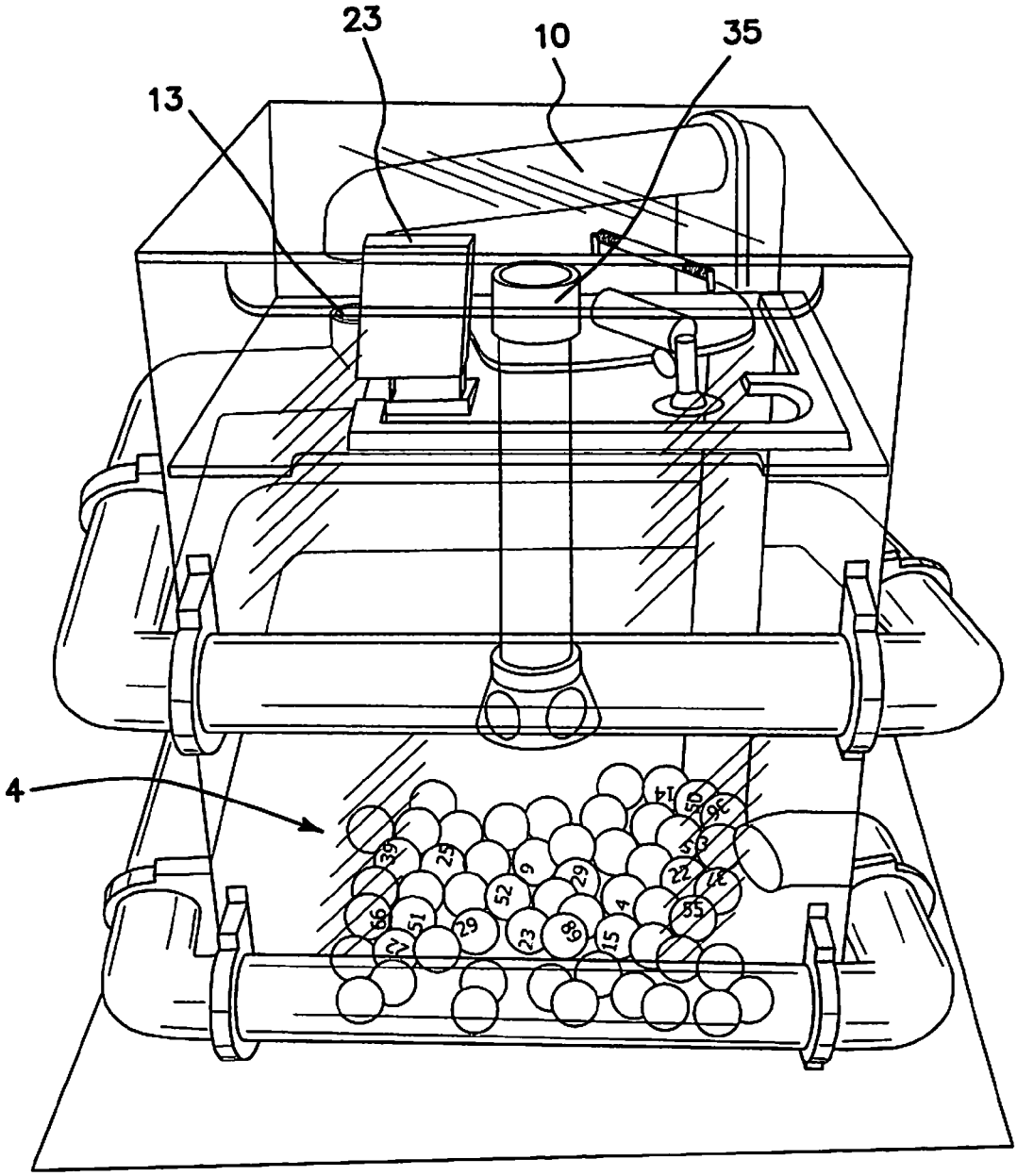
FIG. 6 illustrates a perspective view of an embodiment of a smart ball blower prior to it being activated.

As a result of the blowers 28, 29 being deactivated or switched off, each of the plastic balls 32 within the mixing chamber 1 rest at the bottom of the mixing chamber 1 and tend to congregate near the center of the inverted pyramid 4 as best shown in FIG. 6. When the game begins, the computer 31 activates both the main blower 28 and the auxiliary blower 29. The main blower 28 generates an air stream 36 directed through the air inlet opening at the bottom of the inverted pyramid 4 (see FIG. 1). The air stream 36 suspends and randomly mixes the plastic balls 32 and at some point in time, randomly ejects a ball 37 into the ejecting tube 7 in a manner well-known in the industry.

Figure 7:
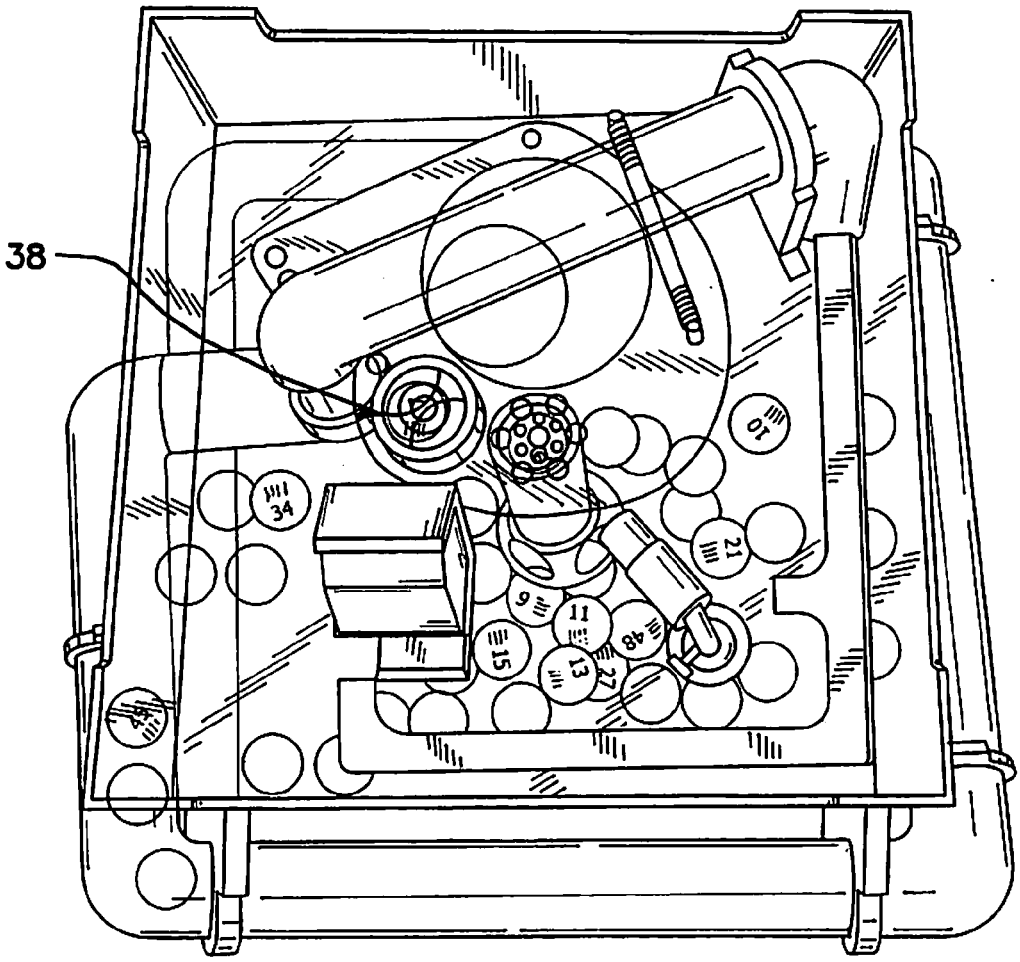
FIG. 7 illustrates an upper view of an embodiment of a smart ball blower with a ball positioned such that it can be scanned by a barcode scanner.

The randomly-ejected ball 37 travels to a cup 35 having a mesh cover top 38 (see FIGS. 3 and 7). While the mesh 38 allows the air stream 36 to vent through the cup 35, it also prevents the randomly ejected ball 37 from escaping from the cup 35. Once the randomly-ejected ball 37 is captured inside the cup 35, its image is processed by the TV camera 22 and relayed to the computer 31 for optional display on TVs or plasma displays located in a gaming establishment (not shown). Also, once the randomly-ejected ball 37 is captured in the cup 35, it can be detected by an optional reflective photo-interrupter or other sensor (not shown) that signals the ball capture event to the computer 31.

Once the ball 37 is captured by the cup 35, the stepper motor 24 rotates the gear disk 26 clockwise (or counterclockwise) thereby causing the carriage mechanism 21 to rotate clockwise (or counterclockwise) by virtue of the frictional engagement between the gear disk 26 and the internal camera opening 27 of the carriage mechanism 21. It is understood that the gear disk 26 and the carriage mechanism 21 can also be rotatably engaged by other suitable means. As a result, the ball 37 captured in the cup 35 of the carriage mechanism 21 is moved through the field of view of the barcode reader or scanner 23. Accordingly, as the ball 37 moves through the field of view of the barcode reader or scanner 23, the scanner 23 captures the barcode 34 and, based thereon, sends the scanned identification number 33 of the ball 37 to the computer 31.

Once the computer 31 receives the ball identification number 33, the stepper motor 24 moves the carriage 21 along with the captured ball 37 further clockwise (or counterclockwise) to a position directly between the inlet 13 of the ball return tube 12 and the outlet of the reversed U-shaped auxiliary tube 10. In this position, under the combined forces of gravity and pressure of the air stream 36 being blown through the auxiliary tube 10 by the auxiliary blower 29, the ball 37 drops from the cup 35 into the inlet 13 of the ball return tube 12 and travels down the tube 12 towards the outlet 16, which at this point in time, is blocked by the closed shaft 17 of the solenoid 18.

Subsequently, the stepper motor 24 returns the ball carriage 21 to its original position wherein the cup 35 is again located directly above the outlet of the central ball ejecting tube 7. From there on, the above-described process of extracting balls 37 from the ball mixing chamber 1, moving the ball 37 through a field of view by the carriage 21, and dropping the ball 37 into the ball return tube 12 under the combined forces of gravity and air stream 36 is repeated for every new ball 37 until the game concludes, e.g., until twenty balls 32 are extracted from the mixing chamber 1 during a conventional keno game. Each of the balls 32 which are extracted subsequently accumulate at one end 16 of the tube 12 under gravity and pressure of the auxiliary air stream 36 generated by the auxiliary blower 29 as best shown in FIG. 1.

Once the game concludes, the computer 31 commands the main air blower 28 to switch off and the solenoid 18 to pull-in the shaft 17 thereby allowing the balls 32 accumulated in the tube 12 to return to the mixing chamber 1 under the pressure of the auxiliary air stream. Once each of the balls 32 are fully ejected from the tube 12 back into the mixing chamber 1 (as may optionally be detected by a second reflective photo-interrupter), the computer 31 restarts the main blower 28 and repeats the above-described process for the next game.

Note that the auxiliary air stream generated by the auxiliary air blower 29 greatly facilitates the process of rolling the balls 32 down the tube 12. Without the auxiliary air stream, balls 32 may tend to cling to the walls of the tube 12 because of electrostatic forces, and gravity alone may not be sufficient to cause the balls 32 to roll into the ball mixing chamber 1 unless the incline of the tube 12 is very steep thereby enlarging the overall size of the smart ball blower. The auxiliary air stream also alleviates the tendency of the balls 32 to electrostatically collect together at the bottom of the mixing chamber 1 at the beginning of the game.

Note also that the tube 12 accumulates each of the balls 32 ejected from the ball ejection tube 7 during the current round of the game and preserves the order in which the balls 32 were ejected, i.e., preserves the history of the game. Since the tube 12 is preferably transparent, the history of the game can be easily ascertained by reviewing the balls 32 contained within the tube 12.

The present invention exemplified by the embodiments described above can be implemented in many other ways without departing from its main principles. In particular, the auxiliary air blower 29 does not necessarily have to be mounted on the inside of the support stand 2 and may, for example, be implemented as a simple fan mounted directly on the top of the support plate 5. Although two separate air blowers 28, 29 are described above, only one such device may be sufficient to generate both the main and auxiliary air streams using a Y-shaped manifold for splitting the air from a single air blower. Moreover, the Y-shaped manifold may be embedded with control valves to allow for separate controls of each of the air streams.

Also, the stepper motor 24 may be implemented as a reversible stepper motor allowing the computer 31 to move the carriage mechanism 21 back and forth in front of the barcode reader or scanner 23 as needed to facilitate scanning the ball barcode 34 or ball number 33. If the barcode 34 cannot be read even after a predetermined number of back and forth oscillations of the carriage mechanism 21 in front of the reader or scanner 23, the computer 31 signals an error condition and stops the game while awaiting human intervention.

The carriage 21 may also incorporate a wing 38 that covers the outlet of the central ball ejecting tube 7 when the cup 35 is positioned directly above the inlet 13 of the ball tube 12. By closing the outlet of the central ball ejecting tube 7, the wing 38 causes air pressure inside of the tube 7 to build-up and as a result, any balls 32 that may be inside of the tube 7 at the time may drop back into the mixing chamber 1. The wing 38 also has the ability to prevent the undesirable effect of several balls 32 accumulating inside the ball ejection tube 7. Since the mixing chamber 1 and the ejection tube 7 are preferably transparent, players can view the contents of the ejection tube 7, i.e., know in advance the ball that is about to be ejected from the tube 7 unless such ball is dropped back into the mixing chamber 1. Also, the carriage 21 may have perforations 39 which increase the speed of ejection of the next ball 37 into the tube 7 while the cup 35 moves back from the position above the inlet 13 of the return tube 12 into the position directly above the ball ejection tube 7.

Although the air mixing chamber 1 as shown in FIG. 1 is a rectangular prism 3, the air chamber 1 may also be implemented as a circular or semicircular prism or any polygonal forms and shapes. Similarly, the ball return tube 12 does not necessarily have to be implemented as a descending staircase 12. It may, for example, be implemented as a down-spiraling pipe leading from the top to the bottom of the air mixing chamber 1. Moreover, the ball return tube 12 does not necessarily have to extend around the ball mixing chamber 1 on the exterior surface but may instead be totally enclosed within the interior surface of the ball mixing chamber 1.

Note that the overall length of the ball return tube 12 can be varied to accommodate a specific number of balls required to be drawn from a particular game. For example, in a British-style bingo game, the ball return tube 12 has to be able to accommodate up to ninety balls while seventy-five balls are drawn for an American-style bingo game, twenty balls are drawn for a keno game and six balls are drawn for a typical lottery game.

Further, a co-pending application to the same assignee discloses event ticket games, only a single ball 37 is required to determine an outcome of the game. In such a game, as soon as the ejected ball 37 is read by the barcode scanner 23, the ball 37 may be immediately returned to the ball mixing chamber 1. For this type of application, the ball return tube 12 may not even be necessary or may be very short and simply constitute a U-shaped extension of the central ball ejection tube 7, while the function of the carriage 21 may be performed by a solenoid 18 that temporarily arrests the ejected ball 37 in order to facilitate reading of the barcode 34 by the reader or scanner 23 and the capturing of the video image of the ball 37 by the TV camera 22. Note that such a simplified embodiment also eliminates the need for the auxiliary air blower 29 and the auxiliary air tube 10 as well.

Having a built-in Ethernet adapter, the smart ball blower may be utilized either as a free-standing ball blower installed in a bingo room or in tandem with another similar ball blower (having a different Internet Protocol address) to form a bingo caller desk with one smart ball blower being utilized for calling regular session bingo games while the other smart ball blower may be utilized for calling special bingo games such as bonanza bingo games. Note also that while the computer 31 is fully capable of automatically controlling the random number generation process, in some environments, e.g., a typical bingo hall, the bingo caller may manually control at least some operations of the ball mixer by inputting respective commands into the computer 31 via a keyboard, mouse or touch screen.

FIG. 1 illustrates an automatic ball blower 10 which preserves the history of bingo balls selected, drawn or called during the current bingo game by virtue of storing all drawn balls in the return tube 12. For example, the return tube 12 may store bingo balls 50 numbered seventy (70), fifty-five (55), forty (40), twenty (20), seven (7), twenty-five (25) and forty-one (41) with the forty-one ball being the first ball drawn in the current bingo game, and the seventy ball being the last ball called in the game as illustrated in FIG. 9. In such a case, the last five balls stored in the tube 12 spell the word "BINGO" as follows: bingo ball seven is conventionally marked with the letter "B;" bingo ball twenty is conventionally marked with the letter "I;" bingo ball forty is conventionally marked with the letter "N;" bingo ball fifty-five is conventionally marked with the letter "G;" and bingo ball seventy is conventionally marked with the letter "O." Since bingo ball seventy is the last bingo ball drawn in the bingo game, it is presumably the bingo ball on which at least one bingo card achieved "BINGO" by virtue of matching the drawn bingo balls with a required bingo card pattern. A winning bingo card is naturally, eligible for a prize, and in one embodiment of the present invention, a player holding a winning bingo card wins a bonus prize (e.g., $1000) if the last five balls stored in the return tube 12 or called spell the word "BINGO." In comparison, if the last five balls in the return tube 12 or called do not spell the word "BINGO," wins a regular bingo prize (e.g., $100). Importantly, the bonus prize may not be a fixed prize but may be a progressive jackpot prize and/or a combination of both a fixed prize and a progressive jackpot prize.

In general, the embodiments of the present invention involve paying a bonus prize to a player playing a winning bingo card responsive to the last bingo balls called in the game matching a predetermined combination of bingo letters (e.g., BINGO) or other identifiable elements associated with the bingo balls. For example, bonus prizes may be paid if the last five bingo balls selected or drawn during the bingo game spell the word BINGO in direct, reverse or scrambled order. Also, a player playing a winning bingo card may be eligible for a bonus prize if the last five bingo balls carry different letters, or in the alternative, all of the same letters, and so on. Also, bonus prizes may be paid out based on various numerical and/or alphabetical characteristics of any two or more last called bingo balls arranged in a pre-established order. For example, a bonus prize may be paid if the last three called bingo balls spell the word "BIG" 52 as illustrated in FIG. 10. A selection of a particular alphanumerical combination for a particular bonus prize may be made by the management based upon a statistical probability of the pre-established combination appearing in the bingo game. In addition, several bonus prizes may be offered to players simultaneously. For example, a "BIG BINGO" bonus prize combination may include both a "BINGO" bonus prize and a "BIG" bonus prize.

In addition, the bingo balls being air-mixed by a ball blower do not have to necessarily be marked or identifiable with conventional bingo letters (i.e., BINGO). For example, the bingo balls may be marked or include identifiable elements, such as state flags and/or be colored with various colors. Moreover, the balls may not be marked with any additional symbols, such as bingo letters. In particular, a pre-established group of last selected bingo balls may be formed based on the numerical value of the balls composing the group. For example, a group of last selected balls may be formed based on a combination of the numbers, e.g., if all seven last called balls end with a number nine, i.e., if the group includes bingo balls nine, nineteen, twenty-nine, thirty-nine, forty-nine, fifty-nine and sixty-nine, then the player of a winning bingo card is paid a bonus prize.

Also, two ball blowers may be utilized concurrently, in tandem. In such a case, each of the ball blowers operating in tandem, may spell a word "BIG" 54, 56 as illustrated in FIG. 11. Obviously, the probability of two ball blowers spelling the word "BIG" simultaneously is lower than the probability of one ball blower spelling the word "BIG," and therefore, a larger bonus may be paid out to a winning bingo card if such a rare event does occur. Also, at least one of the ball blowers operating in tandem may contain bingo balls having identifiable elements, other than numbers and letters. For example, the bingo balls may comprise of various colors, e.g. five yellow (gold) balls, ten gray (silver) balls, twenty red (copper) balls while the rest of the balls are conventional white balls. In such a case, a bonus prize may for example, be paid if colors of the balls drawn from one of the ball blowers operating in tandem match a pre-established condition. In particular, a large bonus prize may be paid if the last five balls drawn from a particular bingo blower are gold and/or if the gold color forms a pre-established pattern on the winning bingo card. In another embodiment, a first ball blower is configured to randomly select bingo balls from a plurality of bingo balls wherein said first ball blower selects bingo game bingo balls and a second ball blower is configured to randomly select bingo balls from a plurality of bingo balls wherein said second ball blower selects bonus bingo balls. A corresponding bonus award is at least partially dependent on a bonus award at least partially dependent on bingo letters and/or numbers associated with two or more last selected bingo balls from said first ball blower during the bingo game comparative to bingo letters and/or bingo numbers associated with two or more bingo balls selected from said second ball blower, wherein a last selected bingo ball from said first ball blower results in a bingo outcome on at least one bingo card. With two bingo ball blowers, one ball blower is used in a conventional fashion to generate bingo game numbers which are used by the players to mark bingo cards while the other bingo ball blower is used for the bonus matching game only.

Also, the ball blower shown and described herein is only one of many conceivable generators of random bingo letters and/or numbers suitable for the embodiments of the present invention. For example, a conventional, non-automatic ball blower or a software-based random number generator may be utilized for essentially the same purpose of generating random combinations of bingo-related alphanumeric symbols that yield bonus prizes. So, electronic bingo games played on stand alone gaming devices or computers accessing to the Internet may utilize the embodiments of the present invention.

Although the invention has been described in detail with reference to several embodiments, additional variations and modifications exist within the scope and spirit of the invention as described and defined in the following claims.

We claim:

1. A method of conducting a bingo game comprising:

utilizing a ball blower or random number generator to randomly identify a series of bingo numbers;

recording on a tangible or electronic bingo board a history of at least two or more bingo numbers called last in the bingo game;

verifying via a scanner or processor at least one winning bingo card marked with a predetermined bingo pattern based on said randomly identified series of bingo numbers; and verifying via a camera and scanner or processor that the two or more bingo numbers called last in the bingo game satisfy at least one pre-established criterion wherein said two or more bingo numbers called last in the bingo game are not identifiable until a winning card is verified.

2. The method of claim 1 further comprising each of the series of bingo numbers being assigned to one of a predetermined number of predetermined numerical ranges and the at least one pre-established criterion comprising a pre-established combination of the predetermined numerical ranges.

3. The method of claim 2 further comprising designating said predetermined numerical ranges as numbers one to fifteen, sixteen to thirty, thirty-one to forty-five, forty-six to sixty, and sixty-one to seventy-five and designated letters B, I, N, G and O, respectively.

4. The method of claim 3 further comprising establishing the at least one criterion as a last five consecutive bingo numbers having designated letters comprising the B, I, N, G and O in any order.

5. The method of claim 3 further comprising establishing the at least one criterion as a last five consecutive bingo numbers having designated letters comprising the B, I, N, G and O sequentially.

6. The method of claim 1 further comprising awarding a winning bingo card a larger prize if the at least one criterion is satisfied.

7. A bingo system comprising:

means for randomly identifying a series of bingo numbers;

means for recording a history of at least two or more bingo numbers called last in the bingo game;

means for verifying at least one winning bingo card marked with a predetermined bingo pattern based on said randomly identified series of bingo numbers; and means for verifying that the two or more bingo numbers called last in the bingo game satisfies at least one pre-established criterion wherein said two or more bingo numbers called last in the bingo game are not identifiable until a winning card is verified.

8. The bingo system of claim 7 wherein said means for randomly identifying a series of bingo numbers comprises a ball blower.

9. The bingo system of claim 7 wherein said means for randomly identifying a series of bingo numbers comprises a random number generator.

* * * * *